US011993478B2

(12) United States Patent
Ge et al.

(10) Patent No.: US 11,993,478 B2
(45) Date of Patent: May 28, 2024

(54) SLOW RETRACTION MECHANISM, LOCKING-TYPE SLOW RETRACTION DEVICE AND WINDING DEVICE

(71) Applicant: INTRADIN (HUZHOU) PRECISION TECHNOLOGY CO., LTD., Huzhou (CN)

(72) Inventors: Guizhong Ge, Huzhou (CN); Xing Zou, Huzhou (CN)

(73) Assignee: INTRADIN (HUZHOU) PRECISION TECHNOLOGY CO., LTD., Huzhou (CN)

( * ) Notice: Subject to any disclaimer, the term of this patent is extended or adjusted under 35 U.S.C. 154(b) by 292 days.

(21) Appl. No.: 17/583,459

(22) Filed: Jan. 25, 2022

(65) Prior Publication Data

US 2022/0144581 A1 May 12, 2022

(30) Foreign Application Priority Data

Jul. 22, 2021 (CN) ..... 202110831893.4

(51) Int. Cl.
*B65H 75/38* (2006.01)
*B65H 75/44* (2006.01)

(52) U.S. Cl.
CPC ..... *B65H 75/4447* (2013.01); *B65H 75/4428* (2013.01); *B65H 2701/33* (2013.01)

(58) Field of Classification Search
CPC ..... B65H 75/38; B65H 75/4428; B65H 75/4434; B65H 75/4442; B65H 75/4447; B65H 2701/33
See application file for complete search history.

(56) References Cited

U.S. PATENT DOCUMENTS 2,976,959 A 3/1961 Husted
3,590,656 A * 7/1971 Lloyd, Jr. ..... B65H 75/4434 188/82.7
4,913,371 A * 4/1990 Margetts ..... B65H 75/486 242/383.5
5,101,082 A * 3/1992 Simmons ..... B65H 75/4471 200/61.15

(Continued)

FOREIGN PATENT DOCUMENTS

CN 105151923 B 4/2017
CN 109132727 A 1/2019

*Primary Examiner* — Sang K Kim

(57) ABSTRACT

A slow retraction mechanism, a locking-type slow retraction device and a winding device. The slow retraction mechanism fits with a winder including a main shaft and a main body rotatably sleeved thereon. The main body can rotate around the main shaft to wind or unwind flexible materials. The slow retraction mechanism includes a blocking part, a decelerating part rotatably arranged on the main body, and an elastic part arranged on the main body and connected with the decelerating part. When the main body rotates around the main shaft in a first direction to wind the flexible material, the decelerating part rotates relative to the main body along a second direction opposite to the first direction to approach the blocking part to rub against the blocking part to reduce a rotation speed. The elastic part applies an elastic force to hinder the decelerating part from rotating along the second direction.

10 Claims, 5 Drawing Sheets

(56) References Cited

U.S. PATENT DOCUMENTS

| | | | | |
|---|---|---|---|---|
| 5,787,923 | A * | 8/1998 | Shea | B65H 75/4434 137/355.23 |
| 9,132,301 | B2 * | 9/2015 | Jones | A62B 35/0093 |
| 2004/0238675 | A1 * | 12/2004 | Banaszkiewicz | B65H 75/4434 242/377 |
| 2016/0081306 | A1 * | 3/2016 | Fikfak | B65H 75/4447 119/796 |

* cited by examiner

SLOW RETRACTION MECHANISM, LOCKING-TYPE SLOW RETRACTION DEVICE AND WINDING DEVICE

CROSS-REFERENCE TO RELATED APPLICATIONS

This application claims the benefit of priority from Chinese Patent Application No. 202110831893.4, filed on Jul. 22, 2021. The content of the aforementioned application, including any intervening amendments thereto, is incorporated herein by reference in its entirety.

TECHNICAL FIELD

The present application relates to retraction of pipe and wire, and more particularly to a slow retraction mechanism, a locking-type slow retraction device and a winding device.

BACKGROUND

When flexible materials (e.g., pipe and wire), are retracted via the automatic retraction winder, the retraction speed will gradually increase. Considering that the excessive retraction speed will threaten the safety of users and cause damage to the winder and the tools attached thereto, a slow retraction mechanism is introduced to rub against the winder to reduce the retraction speed, thereby ensuring the operation safety of the winder. Unfortunately, even the retraction speed of the flexible material has been controlled in a safe range, the slow retraction mechanism will still rub against the winder to slow down the retraction of the flexible material, rendering the whole process unsmooth and inconvenient.

SUMMARY

An objective of this application is to provide a slow retraction mechanism, a locking-type slow retraction device and a winding device to enable the convenient and simple retraction of the flexible materials.

Technical solutions of this application are described as follows.

In a first aspect, this application provides a slow retraction mechanism, wherein the slow retraction mechanism is configured to be adapted to a winder; the winder comprises a main shaft and a main body; the main body is rotatably sleeved on the main shaft; the main body is configured to rotate around the main shaft to wind or unwind a flexible material; the slow retraction mechanism comprises:

a blocking part;

a decelerating part; and a first elastic part;

wherein the blocking part is fixedly connected with the main shaft;

the decelerating part is rotatably arranged on the main body; a projection of the decelerating part along an axial direction of the main shaft falls within a projection of the blocking part along the axial direction of the main shaft; when the main body rotates around the main shaft in a first direction to wind up the flexible material, the decelerating part is configured to rotate relative to the main body along a second direction opposite to the first direction to approach the blocking part; the decelerating part is also configured to be in contact with and rub against the blocking part to reduce a rotation speed of the main body in the first direction; and the first elastic part is arranged on the main body and connected to the decelerating part; and the first elastic part is configured to apply an elastic force on the decelerating part to hinder the decelerating part from rotating in the second direction.

In an embodiment, a side of the decelerating part facing the blocking part is provided with a friction part configured to be in contact with and rub against the blocking part.

In an embodiment, the slow retraction mechanism further comprises a first rotating shaft; wherein the first rotating shaft is arranged on the main body; the decelerating part is rotatably sleeved on the first rotating shaft; and the decelerating part is configured to rotate around the first rotating shaft relative to the main body.

In an embodiment, the slow retraction mechanism further comprises a limiting part; wherein the limiting part is provided on the main body; and the limiting part is configured to limit a rotation of the decelerating part relative to the main body along the first direction.

In an embodiment, a weight of the decelerating part gradually increases from one end of the decelerating part to the other end of the decelerating part.

In a second aspect, this application provides a locking-type slow retraction device, comprising:

a locking mechanism; and the slow retraction mechanism;

wherein the locking mechanism is arranged on the main body; the locking mechanism and the slow retraction mechanism are arranged spaced apart; and the locking mechanism is configured to lock the main body.

In an embodiment, the locking mechanism comprises a locking part and a second elastic part; the locking part is rotatably arranged on the main body; one end of the second elastic part is connected to the main body, and the other end of the second elastic part is connected to the locking part; the second elastic part is configured to apply an elastic force on the locking part to drive the locking part to rotate relative to the main body to allow the locking part to be close to or away from the main shaft, such that the locking part is clamped with or separated from the main shaft to enable locking and unlocking of the main body.

In an embodiment, the locking part has a head end and a tail end opposite to each other; the head end is configured to be clamped with the main shaft; the locking part is provided with an elongated hole extending along a direction from the head end to the tail end; an end of the elongated hole close to the head end is a first end, and an end of the elongated hole close to the tail head is a second end; the locking mechanism further comprises a second rotating shaft arranged on the main body; the locking part is sleevedly provided on the second rotating shaft through the elongated hole; the main body is configured to drive the second rotating shaft to rotate around synchronously the main shaft to drive the second rotating shaft to move between the first end and the second end of the elongated hole; when the second rotating shaft is located at the first end of the elongated hole, the second elastic part is configured to apply an elastic force on the locking part to drive the locking part to rotate relative to the main body in the second direction, so as to drive the head end to move away from the main shaft to separate the head end from the main shaft, thereby releasing the main body; when the second rotating shaft is located at the second end of the elongated hole, the second elastic part is configured to apply an elastic force on the locking part to drive the locking part to rotate relative to the main body in the first direction, so as to drive the tail end to move away from the main shaft; and the head end is configured to move close to the main shaft, such that the head end is clamped with the main shaft, thereby locking the main body.

In an embodiment, the locking mechanism further comprises a ratchet wheel sleevedly provided on the main shaft; and the locking part is configured to be clamped with the ratchet wheel.

In a third aspect, this application provides a winding device, comprising:

the locking-type slow retraction device; and a winder;

wherein the winder comprises a main shaft and a main body; the main body is rotatably sleeved on the main shaft; and the main body is configured to rotate around the main shaft to wind or unwind a flexible material.

Compared with the prior art, this application has the following beneficial effects.

The flexible material wound on the winder is pulled out along the second direction (i.e., the flexible material is unwound), and the flexible material will drive the main body of the winder to rotate around the main shaft in the second direction. If the flexible material is unwound, the main body of the winder will automatically rotate around the main shaft in the first direction to drive the flexible material to be re-wound on the main body of the winder in the first direction. At this time, the decelerating part rotatably provided on the main body of the winder is subjected to a centrifugal force in the second direction opposite to the first direction. When the rotation speed of the main body is higher than a preset speed, the centrifugal force subjected by the decelerating part is higher than the elastic force applied by the first elastic part on the decelerating part, such that the decelerating part overcomes the elastic force to move along the second direction to allow the decelerating part gradually approach the blocking part arranged on the main body until it is in contact with and rubs against the blocking part, thereby reducing the rotation speed of the main body. Due to the arrangement of the first elastic part, when the rotation speed of the winder is no higher than the preset speed, the centrifugal force subjected by the decelerating part is less than the elastic force applied by the first elastic part on the decelerating part to allow the decelerating part to be maintained in the original position and free of interfering in the main body such that the process of the flexible materials retracted by the main body is not influenced, which facilitates the retraction of the flexible materials.

BRIEF DESCRIPTION OF THE DRAWINGS

In order to clearly explain the technical solutions in the embodiments of the present application or the prior art, the drawings that need to be used in the description of the embodiments or the prior art are briefly described below. Obviously, illustrated in the drawings are merely some embodiments of the present application. For those of ordinary skill in the art, other drawings can be obtained based on these drawings without paying creative effort.

Figure 1:
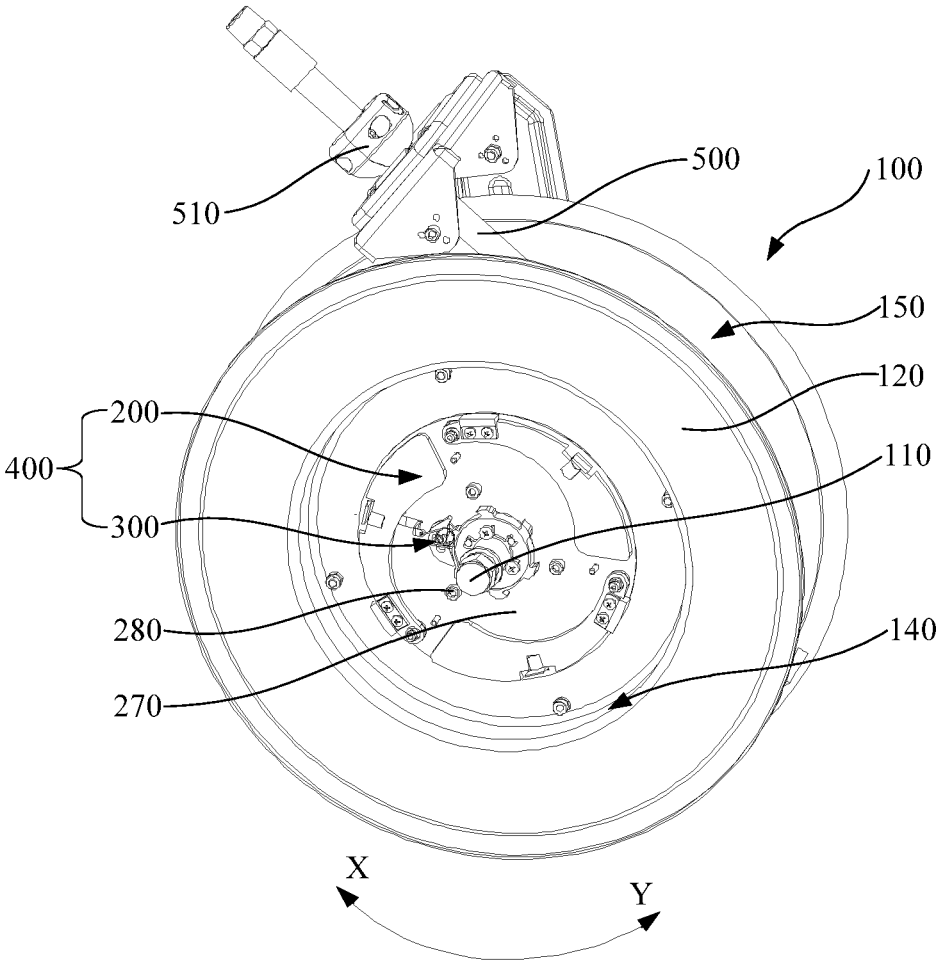
FIG. 1 is a structural diagram of a winding device according to an embodiment of the present disclosure, where a bracket and a blocking part are not shown.

In the drawings, 100: winder; 110: main shaft; 120: main body; 130: bracket; 131: upper bracket; 1311: opening; 132: lower bracket; 140: recess; 150: accommodating groove;

200: slow retraction mechanism; 210: decelerating part; 220: first elastic part; 230: friction part; 240: first fixing part; 250: first rotating shaft; 260: limiting part; 270: bottom plate; 280: second fixing part; 290: blocking part;

300: locking mechanism; 310: locking part; 311: head end; 312: tail end; 313: elongated hole; 3131: first end; 3132: second end; 320: second elastic part; 330: ratchet wheel; 331: gear teeth; 3311: third end; 3312: fourth end; 3313: notch; 340: second rotating shaft;

400: locking-type slow retraction device;

500: flexible material; and 510: gripping part.

The disclosure will be described in detail below with reference to the embodiments and accompanying drawings to make the objectives, functions, and advantages clearer.

DETAILED DESCRIPTION OF EMBODIMENTS

The disclosure will be described in detail below with reference to the accompanying drawings and embodiments of the disclosure to make the technical solutions clear and complete. Obviously, described below are merely some embodiments of the disclosure, and are not intended to limit the disclosure. Other embodiments obtained by those of ordinary skill in the art based on the embodiments provided herein without paying creative effort shall fall within the scope of the present disclosure defined by the appended claims.

It should be noted that as used herein, directional indications (such as up, down, left, right, front and back) are merely intended to explain the relative position relationship and movement situation among individual components in a specific posture (as shown in the accompanying drawings). If the specific posture changes, the directional indication changes accordingly. In addition, relational terms such as "first" and "second" are merely used for description, and cannot be understood as indicating or implying their relative importance or the number of indicated technical features. Thus, the features defined with "first" and "second" may explicitly or implicitly include at least one of the features. Additionally, "and/or" in the disclosure includes three solutions. For example, A and/or B includes technical solution A, technical solution B, and a combination thereof. Additionally, technical solutions of various embodiments can be combined on the premise that the combined technical solution can be implemented by those skilled in the art. When the combination of technical solutions is contradictory or cannot be implemented, it should be considered that such a combination of technical solutions does not exist, nor does it fall within the scope of the present disclosure.

As shown in FIG. 1, this application provides a winding device including a locking-type slow retraction device 400 and a winder 100. The winder 100 includes a main shaft 110 and a main body 120. The main body 120 is rotatably sleeved on the main shaft 110. The main body 120 is configured to rotate around the main shaft 110 to wind or unwind the flexible material 500. The locking-type slow retraction device 400 is arranged on the main body 120.

As shown in FIG. 1, the locking-type slow retraction device 400 includes a slow retraction mechanism 200 and a locking mechanism 300, both of which are arranged spaced apart on the main body 120. The slow retraction mechanism 200 is configured to reduce a rotation speed of the main body 120 in a first direction. The locking mechanism 300 is configured to lock the main body 120. In this embodiment, this disclosure allows the slow retraction mechanism 200 to be unified with the locking mechanism 300 to form a structural unit module (locking-type slow retraction device 400), which improves the space utilization and saves most of the space to allows the production and processing of the products more convenient.

In an embodiment, the locking-type slow retraction device 400 is configured to be applied in the products other than the winder 100 such that the locking-type slow retraction device 400 possesses a wider application scope and higher versatility.

Figure 2:
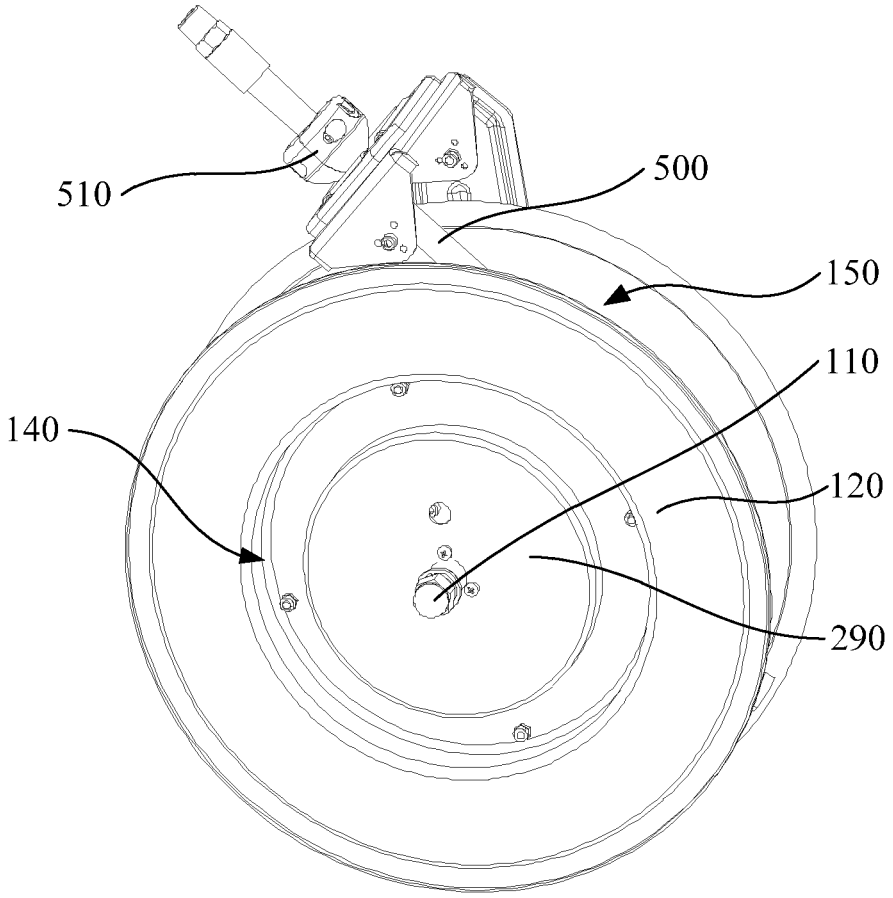
FIG. 2 is a structural diagram of a winding device according to an embodiment of the present disclosure with the bracket not shown.
Figure 3:
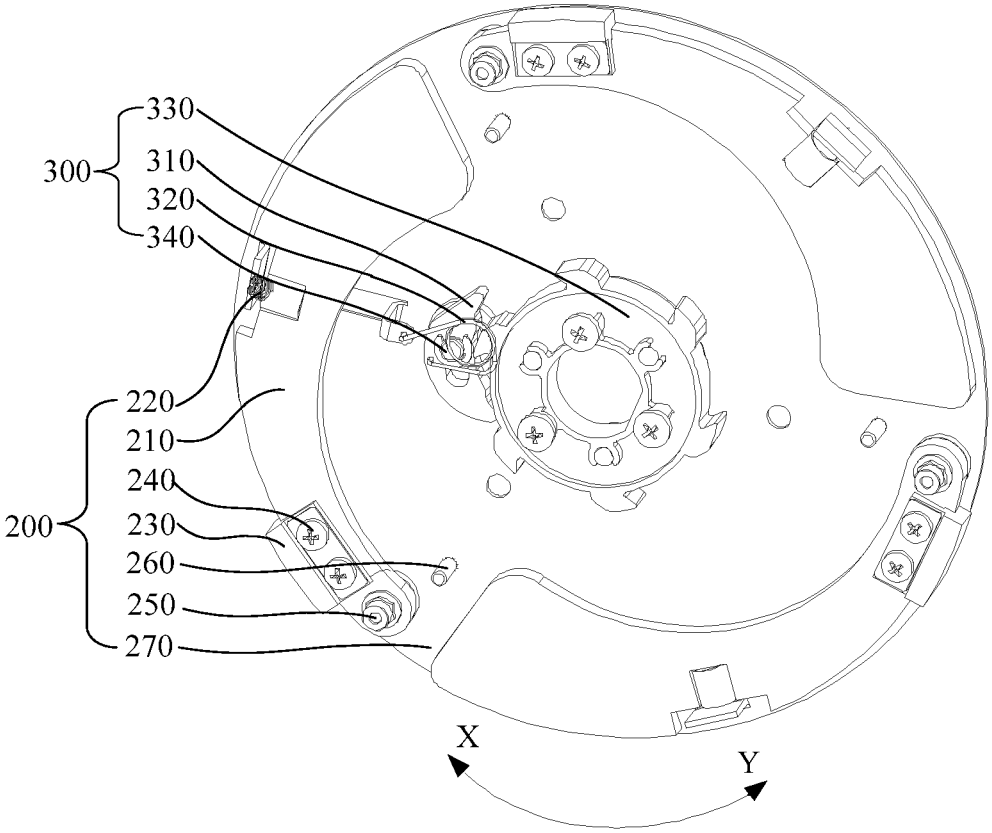
FIG. 3 is a structural diagram of a locking-type slow retraction device according to an embodiment of the present disclosure.

As shown in FIGS. 1-3, the slow retraction mechanism 200 includes a blocking part 290, a decelerating part 210, and a first elastic part 220. The blocking part 290 is fixedly connected to the main shaft 110. The decelerating part 210 is rotatably arranged on the main body 120. A projection of the decelerating part 210 along an axial direction of the main shaft 110 falls within a projection of the blocking part 290 along the axial direction of the main shaft 110. When the main body 120 rotates around the main shaft 110 in a first direction to wind up the flexible material 500, the decelerating part 210 is configured to rotate relative to the main body 120 along a second direction opposite to the first direction to approach the blocking part 290. The decelerating part 210 is also configured to be in contact with and rub against the blocking part 290 to reduce a rotation speed of the main body 120 in the first direction. The first elastic part 220 is arranged on the main body 120 and connected to the decelerating part 210. The first elastic part 220 is configured to apply an elastic force on the decelerating part 210 to hinder the decelerating part 210 from rotating in the second direction.

The flexible material 500 wound on the winder 100 is pulled out in the second direction (i.e., the flexible material 500 is unwound), and the flexible material 500 will drive the main body 120 of the winder 100 to rotate around the main shaft 110 in the second direction. When the flexible material 500 is unwound, the main body 120 of the winder 100 will automatically rotate around the main shaft 110 in the first direction to drive the flexible material 500 to be re-wound on the main body 120 of the winder 100 in the first direction. At this time, the decelerating part 210 rotatably arranged on the main body 120 of the winder 100 is subjected to a centrifugal force in the second direction opposite to the first direction. When the rotation speed of the main body 120 is higher than a preset speed, the centrifugal force subjected by the decelerating part 210 is higher than the elastic force applied by the first elastic part 220 on the decelerating part 210, such that the decelerating part 210 overcomes the elastic force to rotate along the second direction to allow the decelerating part 210 gradually approach the blocking part 290 arranged on the main body 120 until it is in contact with and rubs against the blocking part 290, thereby reducing the rotation speed of the main body 120. Due to the arrangement of the first elastic part 220, when the rotation speed of the winder 100 is no higher than the preset speed, the centrifugal force subjected by the decelerating part 210 is less than the elastic force applied by the first elastic part 220 on the decelerating part 210 to allow the decelerating part 210 to be maintained in the original position and free of interfering in the main body 120 such that the process of the flexible material 500 retracted by the main body 120 is not influenced.

In this embodiment, the first direction is a direction along the X axis shown in FIGS. 1 and 2 and is a clockwise direction. The second direction is a direction along the Y axis shown in FIGS. 1 and 2 and is a counterclockwise direction. In other embodiments, the first direction can be a counterclockwise direction, and the second direction can be a clockwise direction.

In an embodiment, the flexible material 500 can be but not limited to a wire, a tape, or a pipe. The pipe can be but not limited to a steel wire braided hose, a PVC hose, a PU hose, or a rubber hose. The wire can be but not limited to an electric wire or a steel wire rope. The tape can be but not limited to a warning tape, a gauze tape, or a cloth tape. The first elastic part 220 can be but not limited to a spring.

As shown in FIG. 2, in an embodiment, the first elastic part 220 is connected with an end of the decelerating part 210 facing the blocking part 290. The first elastic part 220 is configured to apply an elastic force on the decelerating part 210 to hinder the decelerating part 210 from rotating along the second direction.

In one embodiment, the blocking part 160 has an annular structure. The decelerating part 210 is configured to be in contact with and rub against an inner sidewall of the annular blocking part 160, thereby reducing the rotation speed of the main body 120.

In an embodiment, the blocking part 160 is a housing fixedly sleeved on the main shaft 110. The first elastic part 220 and the decelerating part 210 are located in the housing. The decelerating part 210 is configured to be in contact with and rub against an inner sidewall of the housing to reduce the rotation speed of the main body 120. In this embodiment, the housing is configured to the first elastic part 220 and the decelerating part 210 to make the slow retraction mechanism 200 to be more beautiful.

As shown in FIGS. 1 and 2, in an embodiment, a side of the main body 120 is provided with a recess 140. The slow retraction mechanism 200 is arranged in the recess 140 to prevent the slow retraction mechanism 200 from protruding out of the main body 120, thereby improving the space utilization.

In an embodiment, the decelerating part 210 is rotatably arranged on a bottom wall of the recess 140. The first elastic part 220 is arranged on the bottom wall of the recess 140.

As shown in FIG. 2, in an embodiment, an outer circumstance of the main body 120 is provided with an accommodating groove 150 recessed along a radial direction of the main body 120. The flexible material 500 is configured to be wound around the accommodating groove 150 of the main body 120. In this embodiment, a side wall of the accommodating groove 150 is configured to prevent the flexible material 500 from falling off the main body 120.

As shown in FIG. 3, in an embodiment, a side of the decelerating part 210 facing the blocking part 290 is provided with a friction part 230 configured to be in contact with and rub against the blocking part 290.

In an embodiment, the friction part 230 can be but not limited to be made of a rubber material.

In an embodiment, the friction part 230 is detachably arranged on the decelerating part 210. In this embodiment, when the friction part 230 is worn or damaged, it is convenient to disassemble and replace the friction part 230.

As shown in FIG. 3, in an embodiment, the slow retraction mechanism 200 further includes a first fixing part 240 configured to fix the friction part 230 on the decelerating part 210.

In an embodiment, the first fixing part 240 is configured to pass through the friction part 230 to be adapted to the decelerating part 210 to fix the friction part 230 on the decelerating part 210.

As shown in FIG. 3, in an embodiment, the number of the first fixing parts 240 is multiple. The plurality of first fixing parts 240 are arranged spaced apart relative to the friction part 230 to allow the friction part 230 to be more reliably fixed to the decelerating part 210. In this embodiment, the number of the first fixing parts 240 is two. Two first fixing parts 240 are arranged spaced apart relative to the friction part 230 to allow the friction part 230 to be more reliably fixed to the decelerating part 210.

In an embodiment, the first fixing part 240 can be but not limited to a screw or a bolt.

As shown in FIG. 3, in an embodiment, the slow retraction mechanism 200 further includes a first rotating shaft 250 arranged on the main body 120. The decelerating part 210 is rotatably sleeved on the first rotating shaft 250 to rotate around the first rotating shaft 250 relative to the main body 120.

As shown in FIG. 2, in an embodiment, an end of the decelerating part 210 is rotatably sleeved on the first rotating shaft 250.

As shown in FIG. 3, in an embodiment, the friction part 230 is arranged at an end of the decelerating part 210 sleevedly arranged on the first rotating shaft 250. In this embodiment, when arranged in this way, the friction part 230 is relatively far from an end of the decelerating part 210 away from the first rotating shaft 250, such that the decelerating part 210 rotates to allow the friction part to be subjected to a higher centrifugal force, thereby the friction between the friction part 230 and the blocking part 290 is more reliable.

As shown in FIG. 3, in an embodiment, the slow retraction mechanism 200 further includes a limiting part 260 arranged on the main body 120 and configured to limit a rotation of the decelerating part 210 relative to the main body 120 along the first direction. In this embodiment, the limiting part 260 is arranged to avoid the interference with the main body 120 when the decelerating part 210 rotates in the first direction.

In an embodiment, the limiting part 260 is arranged adjacent to a side where the decelerating part 210 is connected to the first elastic part 220. In this embodiment, when the flexible material 500 wound on the main body 120 of the winder 100 is pulled out in the second direction, the decelerating part 210 rotatably arranged on the main body 120 is subjected to the centrifugal force in a direction opposite to the second direction such that the decelerating part 210 rotates along the first direction opposite to the second direction to allow the decelerating part 210 to gradually approach and abut against the limiting part 260 to hinder the decelerating part 210 from continuing rotating along the first direction, thereby the limiting part 260 limits the decelerating part 210.

In an embodiment, a weight of the decelerating part 210 gradually increases from one end of the decelerating part 210 to the other end of the decelerating part 210. In this embodiment, it is arranged in this way so that when the main body 120 rotates in the first direction, the decelerating part 210 rotatably arranged on the main body 120 is subjected to a higher centrifugal force along a direction opposite to the second direction, thereby allowing the decelerating part 210 to be in contact with and intensively rub against the blocking part 290 such that the decelerating part 210 is configured to reduce the rotation speed of the main body 120 more reliably.

As shown in FIG. 2, in an embodiment, a width of the decelerating part 210 gradually increases from one end of the decelerating part 210 to the other end of the decelerating part 210, so as to realize that the weight of the decelerating part 210 gradually increases along a direction from an end of the decelerating part 210 with a smaller width to an end of the decelerating part 210 with a larger width.

As shown in FIG. 2, in an embodiment, the weight of the decelerating part 210 gradually increases along a direction from an end of the decelerating part 210 rotatably sleeved on the first rotating shaft 250 to an end of the decelerating part 210 away from the first rotating shaft 250.

As shown in FIGS. 1 and 3, in an embodiment, the slow retraction mechanism 200 further includes a bottom plate 270. The decelerating part 210 and the first elastic part 220 are arranged on the main body 120 through the bottom plate 270. In this embodiment, the bottom plate 270 is fixed to the main body 120. The decelerating part 210 is rotatably arranged on the bottom plate 270. The first elastic part 220 is arranged on the bottom plate 270. In this embodiment, the bottom plate 270 is fixed on the bottom wall of the recess 140.

In one embodiment, the first rotating shaft 250 and the limiting part 260 are arranged on the bottom plate 270.

Figure 6:
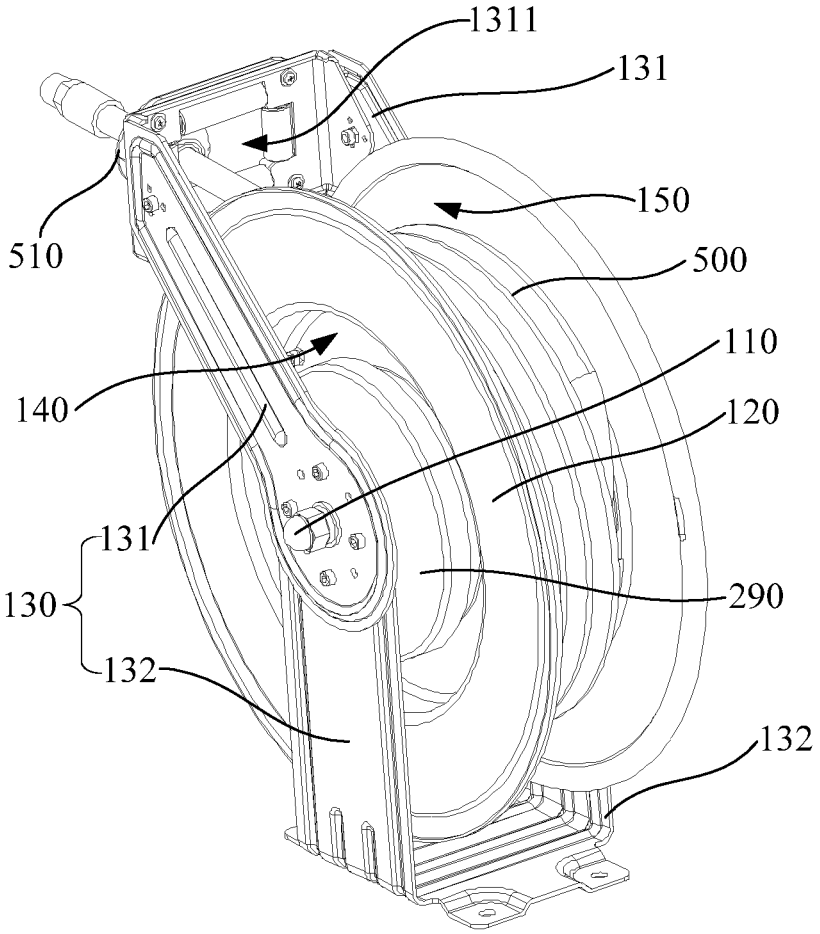
FIG. 6 is a structural diagram of the winding device according to an embodiment of the present disclosure.

As shown in FIGS. 2 and 6, in an embodiment, the blocking part 290 is rotatably covered on the bottom plate 270. The decelerating part 210, the first elastic part 220, the first rotating shaft 250 and the limiting part 260 are all located in a space enclosed by the blocking part 290 and the bottom plate 270.

As shown in FIG. 1, in an embodiment, the slow retraction mechanism 200 further includes a second fixing part 280 configured to fix the bottom plate 270 on the main body 120.

In an embodiment, the second fixing part 280 passes through the bottom plate 270 to be adapted to the main body 120 to fix the bottom plate 270 on the main body 120.

As shown in FIG. 1, in an embodiment, the number of the second fixing parts 280 is multiple. The plurality of the second fixing parts 280 are arranged spaced apart relative to the bottom plate 270 to fix the bottom plate 270 on the main shaft 110 more reliably. In this embodiment, the number of the second fixing parts 280 is three. Three second fixing parts 280 are arranged spaced apart relative to the bottom plate 270 to more reliably fix the bottom plate 270 on the main shaft 110.

In an embodiment, the second fixing part 280 can be but not limited to a screw or a bolt.

As shown in FIG. 1, in an embodiment, the number of slow retraction mechanisms 200 is multiple. The plurality of slow retraction mechanisms 200 are arranged spaced apart on the main body 120 of the winder 100. When the rotation speed of the main body 120 around the main shaft 110 along the first direction is higher than the preset speed, the plurality of the slow retraction mechanisms 200 are configured to reduce the rotation speed of the main body 120 more reliably. In this embodiment, the number of slow retraction mechanisms 200 is three. Three slow retraction mechanisms 200 are arranged spaced apart on the main body 120 of the winder 100. When the rotation speed of the main body 120 around the main shaft 110 in the first direction is higher than the preset speed, the three slow retraction mechanisms 200 are configured to reduce the rotation speed of the main body 120 more reliably.

In an embodiment, the locking mechanism 300 is arranged on the bottom plate 270.

As shown in FIGS. 1 and 3, in an embodiment, the locking mechanism 300 includes a locking part 310 and a second elastic part 320. The locking part 310 is rotatably arranged on the main body 120. One end of the second elastic part 320 is connected to the main body 120, and the other end of the second elastic part 320 is connected to the locking part 310. The second elastic part 320 is configured to apply an elastic force to the locking part on drive the locking part 310 to rotate relative to the main body 120 to allow the locking part 310 to be close to or away from the main shaft 110, such that the locking part 310 is clamped with or separated from the main shaft 110 to enable locking and unlocking of the main body 120. In this embodiment, considering that the main shaft 110 does not rotate, if the locking part 310 is clamped with the main shaft 110, the locking part 310 is clamped with the main shaft 110, the locking part 310 will fail to keep stationary when the main body 120 rotates in the first direction synchronously such that the main body 120 fails to keep stationary, so as to lock the main body 120.

In an embodiment, the locking part 310 can be but not limited to a pawl. The second elastic part 320 can be but not limited to a spring.

In an embodiment, when the flexible material 500 wound on the main body 120 is pulled out in the second direction, the flexible material 500 will drive the main body 120 to rotate in the second direction around the main shaft 110. If the flexible material 500 is unwound, the main body 120 is configured to rotate around the main shaft 110 in the first direction to drive the flexible material 500 to be re-wound on the main body 120. At this time, the second elastic part 320 is configured to apply an elastic force on the locking part 310 to drive the locking part 310 to rotate along the first direction relative to the main body 120 to allow the locking part to be close to the main shaft 110 such that the locking part 310 is clamped with the main shaft 110 to enable the locking of the main body 120 by the locking part 310 to allow the main body 120 to fail to continue rotating along the first direction.

Figure 4:
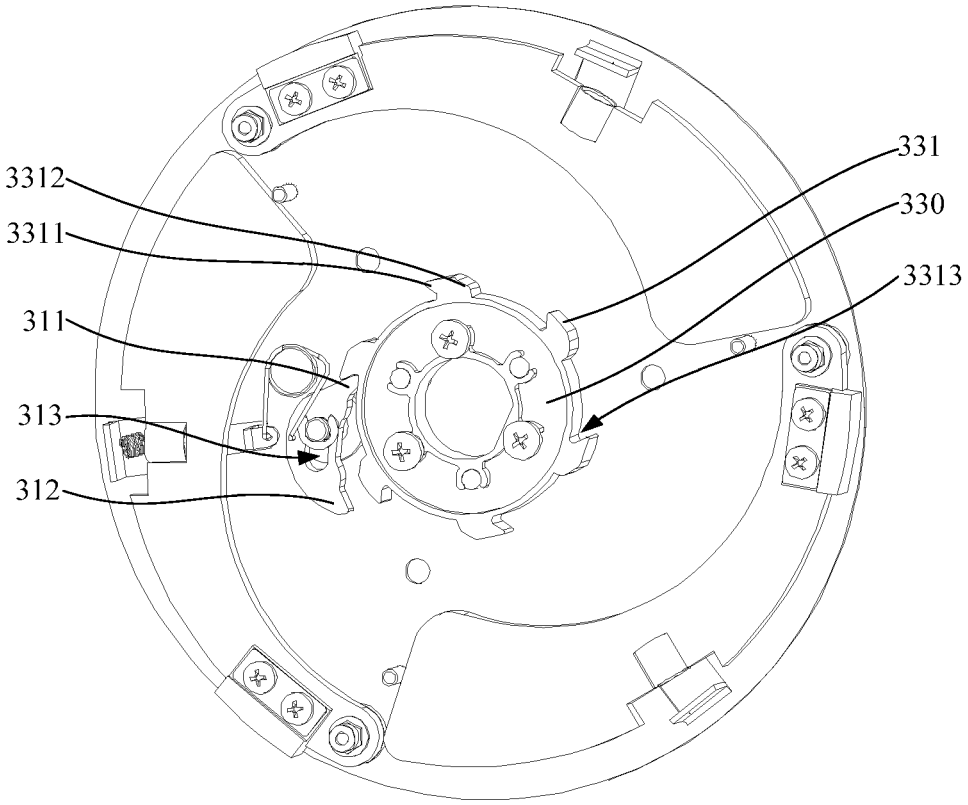
FIG. 4 is a structural diagram of the locking-type slow retraction device according to another embodiment of the present disclosure.
Figure 5:
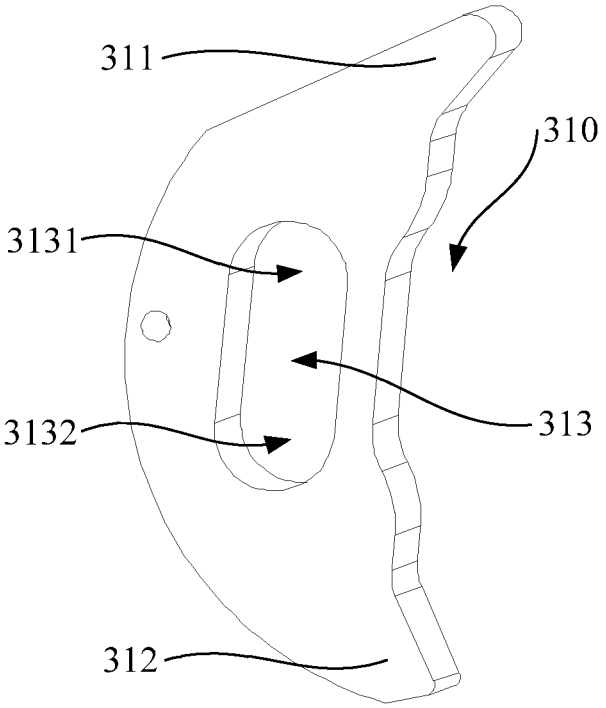
FIG. 5 is a structural diagram of a locking part according to an embodiment of the present disclosure.

As shown in FIGS. 3-5, in an embodiment, the locking part 310 has a head end 311 and a tail end 312 opposite to each other. The head end 311 is configured to be clamped with the main shaft 110. The locking part 310 is provided with an elongated hole 313 extending along a direction from the head end 311 to the tail end 312. An end of the elongated hole 313 close to the head end 311 is a first end 3131, and an end of the elongated hole 313 close the tail end 312 is a second end 3132. The locking mechanism 300 further includes a second rotating shaft 340 arranged on the main body 120. The locking part 310 is rotatably sleeved on the second rotating shaft 340 through the elongated hole 313. The main body 120 is configured to drive the second rotating shaft 340 to rotate synchronously around the main shaft 110, such that the second rotating shaft 340 moves between the first end 3131 and the second end 3132 of the elongated hole 313. When the second rotating shaft 340 is located at the first end 3131 of the elongated hole 313, the second elastic part 320 is configured to apply an elastic force on the locking part 310 to drive the locking part 310 to rotate relative to the main body 120 in the second direction to drive the head end 311 to move along a direction away from the main shaft 110, such that the head end 311 is separated from the main shaft 110 to release the main body 120. When the second rotating shaft 340 is located at the second end 3132 of the elongated hole 313, the second elastic part 320 is configured to apply an elastic force on the locking part 310 to drive the locking part 310 to rotate relative to the main body 120 in the first direction to drive the tail end 312 to move along a direction away from the main shaft 110, at the same time, the head end 311 will move close to the main shaft 110 to allow the head end to be clamped with the main shaft 110 to lock the main body 120. In this embodiment, the second rotating shaft 340 is arranged on the bottom plate 270.

As shown in FIGS. 3-5, when the flexible material 500 is retracted to the main body 120, the main body 120 of the winder 100 is configured to automatically rotate around the main shaft 110 in the first direction. Under the current state, the second rotating shaft 340 is located at the second end 3132 of the elongated hole 313. The second elastic part 320 is configured to apply an elastic force on the locking part 310 to drive the locking part 310 to rotate in the first direction relative to the main body 120 to drive the tail end 312 to move away from the main shaft 110. At the same time, the locking part 310 rotates synchronously with the bottom plate 370 along the first direction through the second elastic part 310 to allow the head end 311 of the locking part 310 gradually approach the position where the locking part 310 is clamped with the main shaft 110 until the locking part 310 is clamped with the main shaft 110, so as to lock the main body 120. The second rotating shaft 340 is also configured to rotate synchronously with the bottom plate 270 relative to the elongated hole 313 along the first direction, so as to allow the second rotating shaft 340 to be switched from the second end 3132 of the elongated hole 313 to the first end 3131.

As shown in FIGS. 3-5, when the flexible material 500 wound on the main body 120 is gently pulled out in the second direction, the flexible material 500 will drive the main body 120 to rotate in the second direction around the main shaft 110, and the locking part 310 will synchronously rotate with the bottom plate 270 to allow the locking part 310 away from the position where the locking part is clamped with the main shaft 110, and subsequently the second elastic part 320 is configured apply an elastic force on the locking part 310 to drive the locking part 310 to rotate in the second direction relative to the main body 120 to drive the head end 311 to move away from the main shaft 110, such that the head end 311 of the locking part 310 is away from the main shaft 110, thereby releasing the main body 120. As a result, the flexible material 500 wound on the main shaft 120 of the winder 100 is pulled out normally.

As shown in FIG. 3, in an embodiment, the locking mechanism 300 further includes a ratchet wheel 330 sleevedly arranged on the main shaft 110. The locking part 310 is configured to be clamped with the ratchet wheel 330. In this embodiment, the head end 311 of the locking part 310 is configured to be close to the ratchet wheel 330 and clamped with the ratchet wheel 330 to lock the main body 120. In this embodiment, the locking mechanism 300 adopts a structure of a ratchet wheel 330 and a pawl (locking part 310), which has simple structure and high stability, and is less sensitive to the materials.

As shown in FIGS. 3 and 4, in an embodiment, the outer circumstance of the ratchet wheel 330 is provided with gear teeth 331. The head end 311 of the locking part 310 is configured to be clamped with the gear teeth 331 of the ratchet wheel 330 to lock the main body 120.

As shown in FIGS. 3-5, in an embodiment, the gear teeth 331 have a third end 3311 and a fourth end 3312 opposite to each other. The third end 3311 of the gear teeth 331 is provided with a notch 3313. The head end 311 of the locking part 310 is configured to be accommodated in the notch 3313 of the third end 3311 of the gear teeth 331, such that the locking part 310 is clamped with the gear teeth 331. In this embodiment, when the locking part 310 rotates with the main body 120 of the winder 100 along the first direction, the head end 311 of the locking part 310 is configured to gradually approach the third end 3311 of the gear teeth 331, such that the locking part 310 is clamped with the gear teeth 331. When the locking part 310 rotates with the main body 120 of the winder 100 along the second direction, the head end 311 of the locking part 310 is configured to gradually approach the fourth end 3312 of the gear teeth 331. Considering that the fourth end 3312 of the gear teeth 331 is not provided with a notch, the locking part 310 fails to be clamped with the gear teeth 331, such that the continuous rotation of the main body 120 of the winder 100 along the second direction is unaffected. In FIG. 2, the locking part 310 is not clamped with the gear teeth 331. In FIG. 3, the head end 311 of the locking part 310 is accommodated in the notch 3313 on the third end 3311 of the gear teeth 331, and the locking part 310 is clamped with the ratchet wheel 331.

As shown in FIG. 4, in an embodiment, a shape of the notch 3313 matches a shape of the head end 311 of the locking part 310.

As shown in FIG. 4, in an embodiment, the number of the gear teeth 331 is multiple. The plurality of gear teeth 331 are arranged spaced apart on the outer circumference of the ratchet wheel 330. In this embodiment, when the locking part 310 rotates with the main body 120 of the winder 100 along the first direction, the head end 311 of the locking part 310 is configured to be clamped with the gear teeth 331 closest to the locking part 310 to lock the main body 120.

As shown in FIG. 4, in an embodiment, a plurality of gear teeth 331 are evenly distributed along the outer circumference of the ratchet wheel 330.

As shown in FIG. 6, in an embodiment, the winder 100 further includes a bracket 130 connected to the main shaft 110. The bracket 130 is configured to support the main shaft 110. In this embodiment, the bracket 130 is arranged to allow the winder 100 to be placed more conveniently.

As shown in FIG. 6, in an embodiment, the number of brackets 130 is two. Each of the two brackets 130 are respectively connected to each of two opposite ends of the main shaft 110. In this embodiment, both of the two brackets 130 support the main shaft 110 such that the main shaft 110 is supported more reliably.

As shown in FIG. 6, in an embodiment, the bracket 130 includes an upper bracket 131 and a lower bracket 132, both of which are connected to the main shaft 110. The lower bracket 132 is configured to support the main shaft 110. The upper bracket 131 is provided with an opening 1311. The upper bracket 131 is configured to guide the flexible material 500 through the opening 1311. In this embodiment, the flexible material 500 wound on the main body 120 is configured to be pulled out of the main body 120 through the guide of the opening 1311, or the pulled flexible material 500 is configured to be re-wound on the main body 120 through the guide of the opening 1311.

As shown in FIG. 1, in an embodiment, one end of the flexible material 500 is provided with a gripping part 510 configured for a person to hold by hand. In this embodiment, the human hand holds the gripping part 510 and applies a force to pull out the flexible material 500 wound on the winder 100 in the second direction.

In an embodiment, the size of the opening 1311 on the upper bracket 131 is smaller than that of the gripping part 510 of the flexible material 500. In this embodiment, when the flexible material 500 is re-wound on the winder 100, considering that the size of the gripping part 510 is larger than that of he opening 1311 of the upper bracket 131, the gripping part 510 is blocked by the upper bracket 131 to prevent the flexible material 500 from falling off relative to the main body 120.

The processes of cooperation and action among each mechanism of the winding device are as follows:

As shown in FIGS. 2 and 3, the flexible material 500 wound on the main body 120 of the winder 100 is pulled out along the second direction, and the flexible material 500 will drive the main body 120 to rotate in the second direction around the main shaft 110. The locking part 310 will rotate synchronously with the bottom plate 270 fixed on the main body 120, that is, the locking part 310 will rotate along the outer circumference of the ratchet wheel 330 sleevedly provided on the main shaft 110, and the main body 120 is not locked. At the same time, the decelerating part 210 rotatably arranged on the bottom plate 270 is subjected to a centrifugal force along the first direction opposite to the second direction such that the decelerating part 210 rotates in the first direction to allow the decelerating part 210 to approach and abut against the limiting part 260 to block the decelerating part 210 from continuing rotating in the first direction. At this time, the bottom plate 270 of the decelerating part 210 fixed on the main body 120 causes interference. As a result, the flexible material 500 wound on the main body 120 of the winder 100 is normally pulled out.

As shown in FIGS. 3-5, if the flexible material 500 is unwound at this time, the main body 120 of the winder 100 is configured to automatically rotate in the first direction around the main shaft 110. Under the current state, the second rotating shaft 340 is located at the second end 3132 of the elongated hole 313. The second elastic part 320 is configured to apply an elastic force on the locking part 310 to drive the locking part 310 to rotate in the first direction relative to the main body 120 to drive the tail end 312 to move away from the ratchet wheel 330. At the same time, the head end 311 will move close to the ratchet wheel 330, and the locking part 310 rotates in the first direction synchronously with the bottom plate 270 through the second elastic part 320 to allow the head end 311 of the locking part 310 to gradually approach the third end 3311 of the gear teeth 331 until the head end 311 of the locking part 310 is accommodated in the notch 3313 on the third end 3311 of the gear teeth 331, such that the locking part 310 is clamped with the gear teeth 331, thereby realizing the locking of the main body 120 by the locking part 310. The second rotating shaft 340 is also configured to rotate synchronously with the bottom plate 270 relative to the elongated hole 313 along the first direction to allow the second rotating shaft 340 to be switched from the second end 3132 of the elongated hole 313 to the first end 3131.

As shown in FIGS. 3-5, when the flexible material 500 wound on the main body 120 is gently pulled out in the second direction again, the flexible material 500 will drive the main body 120 to rotate in the second direction around the main shaft 110. The locking part 310 will rotate synchronously with the bottom plate 270 such that the head end 311 of the locking part 310 exits from the notch 3313 on the third end 3311 of the gear teeth 331, and subsequently the second elastic part 320 is configured to apply an elastic force on the locking part 310 to actuate the locking part 310 rotate relative to the main body 120 along the second direction to drive the head end 311 to move away from the ratchet wheel 330 to allow the head end 311 of the locking part 310 to be away from the ratchet wheel 330 to unlock the main body 120.

As shown in FIG. 3-5, if the flexible material 500 is unwound at this time, the main body 120 is configured to automatically rotate in the first direction around the main shaft 110. Considering that the locking part 310 and the gear teeth 331 of the ratchet wheel 330 have been released from the clamping, the flexible material 500 is configured to rotate with the main body 120 in the first direction, such that the flexible material 500 is gradually wound on the main body 120 to realize the winding of the flexible material 500.

As shown in FIGS. 3-5, if the flexible material 500 wound on the main body 120 of the winder 100 is continuously pulled out in the second direction at this time, the second rotating shaft 340 will rotate synchronously with the bottom plate 270 fixed on the main body 120 with respect to the elongated hole 313, such that the second rotating shaft 340 is switched from the first end 3131 of the elongated hole 313 to the second end 3132. Under the current state, the locking part 310 rotates synchronously with the bottom plate 270 along the second direction through the second elastic part 320. The head end 311 of the locking part 310 is configured to gradually approach and be in contact with the fourth ends 3312 of different gear teeth 331. Considering that the fourth end 3312 of the gear teeth 331 is not provided with a notch 3313, the head end 311 of the locking part 310 is not clamped with the forth end 3312 of each gear tooth 331, that is, the main body 120 will not be locked, such that the flexible material 500 wound on the main body 120 of the winder 100 is normally pulled out.

Described above are merely preferred embodiments of the disclosure, which are not intended to limit the scope of the application. It should be understood that any replacements, modifications and changes made by those skilled in the art without departing from the spirit of the application shall fall within the scope of the present application defined by the appended claims.

What is claimed is:

1. A slow retraction mechanism, wherein the slow retraction mechanism is configured to be adapted to a winder; the winder comprises a main shaft and a main body; the main body is rotatably sleeved on the main shaft; the main body is configured to rotate around the main shaft to wind or unwind a flexible material; the slow retraction mechanism comprises:

a blocking part;

a decelerating part; and a first elastic part;

wherein the blocking part is fixedly connected with the main shaft;

the decelerating part is rotatably arranged on the main body; a projection of the decelerating part along an axial direction of the main shaft falls within a projection of the blocking part along the axial direction of the main shaft; when the main body rotates around the main shaft in a first direction to wind the flexible material, the decelerating part is configured to rotate relative to the main body along a second direction opposite to the first direction to approach the blocking part; the decelerating part is also configured to be in contact with and rub against the blocking part to reduce a rotation speed of the main body in the first direction; and the first elastic part is arranged on the main body and connected to the decelerating part; and the first elastic part is configured to apply an elastic force on the decelerating part to hinder the decelerating part from rotating in the second direction.

2. The slow retraction mechanism of claim 1, wherein a side of the decelerating part facing the blocking part is provided with a friction part configured to be in contact with and rub against the blocking part.

3. The slow retraction mechanism of claim 1, further comprising:

a first rotating shaft;

wherein the first rotating shaft is arranged on the main body; the decelerating part is rotatably sleeved on the first rotating shaft; and the decelerating part is configured to rotate around the first rotating shaft relative to the main body.

4. The slow retraction mechanism of claim 1, further comprising:

a limiting part;

wherein the limiting part is provided on the main body; and the limiting part is configured to limit a rotation of the decelerating part relative to the main body along the first direction.

5. The slow retraction mechanism of claim 4, wherein a weight of the decelerating part increases from one end of the decelerating part to the other end of the decelerating part.

6. A locking-type slow retraction device, comprising:

a locking mechanism; and the slow retraction mechanism of claim 1;

wherein the locking mechanism is arranged on the main body; the locking mechanism and the slow retraction mechanism are arranged spaced apart; and the locking mechanism is configured to lock the main body.

7. The locking-type slow retraction device of claim 6, wherein the locking mechanism comprises a locking part and a second elastic part; the locking part is rotatably arranged on the main body; one end of the second elastic part is connected to the main body, and the other end of the second elastic part is connected to the locking part; the second elastic part is configured to apply an elastic force on the locking part to drive the locking part to rotate relative to the main body to allow the locking part to be close to or away from the main shaft, such that the locking part is clamped with or separated from the main shaft to enable locking and unlocking of the main body.

8. The locking-type slow retraction device of claim 7, wherein the locking part has a head end and a tail end opposite to each other; the head end is configured to be clamped with the main shaft; the locking part is provided with an elongated hole extending along a direction from the head end to the tail end; an end of the elongated hole close to the head end is a first end, and an end of the elongated hole close to the tail head is a second end; the locking mechanism further comprises a second rotating shaft arranged on the main body; the locking part is sleevedly provided on the second rotating shaft through the elongated hole; the main body is configured to drive the second rotating shaft to rotate synchronously around the main shaft to drive the second rotating shaft to move between the first end and the second end of the elongated hole; when the second rotating shaft is located at the first end of the elongated hole, the second elastic part is configured to apply an elastic force on the locking part to drive the locking part to rotate relative to the main body in the second direction, so as to drive the head end to move away from the main shaft to separate the head end from the main shaft, thereby releasing the main body; when the second rotating shaft is located at the second end of the elongated hole, the second elastic part is configured to apply an elastic force on the locking part to drive the locking part to rotate relative to the main body in the first direction, so as to drive the tail end to move away from the main shaft and the head end to move close to the main shaft, such that the head end is clamped with the main shaft, thereby locking the main body.

9. The locking-type slow retraction device of claim 7, wherein the locking mechanism further comprises a ratchet wheel sleevedly provided on the main shaft; and the locking part is configured to be clamped with the ratchet wheel.

10. A winding device, comprising:

the locking-type slow retraction device of claim 6; and the winder;

wherein the winder comprises the main shaft and the main body; the main body is rotatably sleeved on the main shaft; and the main body is configured to rotate around the main shaft to wind or unwind the flexible material.

* * * * *